US008173956B2

(12) United States Patent
James et al.

(10) Patent No.: US 8,173,956 B2
(45) Date of Patent: May 8, 2012

(54) DYNAMIC PIXEL SCANNING FOR USE WITH MALDI-MS

(75) Inventors: Andrew James, Toronto (CA); George Scott, Toronto (CA); Min J. Yang, Maple (CA)

(73) Assignee: DH Technologies Pte. Ltd., Singapore (SG)

( * ) Notice: Subject to any disclaimer, the term of this patent is extended or adjusted under 35 U.S.C. 154(b) by 225 days.

(21) Appl. No.: 11/779,970

(22) Filed: Jul. 19, 2007

(65) Prior Publication Data

US 2008/0017793 A1 Jan. 24, 2008

Related U.S. Application Data

(60) Provisional application No. 60/807,776, filed on Jul. 19, 2006.

(51) Int. Cl.
*H01J 49/16* (2006.01)

(52) U.S. Cl. ..... 250/282; 250/281; 250/288; 250/307; 250/491.1; 250/492.1

(58) Field of Classification Search ..... 250/281, 250/282, 283, 288, 423 R, 491.1, 492.1, 493.1, 250/306, 307
See application file for complete search history.

(56) References Cited

U.S. PATENT DOCUMENTS

| | | | | |
|---|---|---|---|---|
| 5,808,300 | A | 9/1998 | Caprioli | |
| 6,248,592 | B1 | 6/2001 | Nogar | |
| 6,504,150 | B1 * | 1/2003 | Verentchikov et al. | 250/286 |
| 6,617,577 | B2 | 9/2003 | Krutchinsky et al. | |
| 7,851,744 | B2 * | 12/2010 | Brown et al. | 250/284 |
| 2003/0129666 | A1 * | 7/2003 | Tanaka et al. | 435/7.2 |
| 2003/0136906 | A1 * | 7/2003 | Marsh | 250/309 |
| 2003/0178562 | A1 * | 9/2003 | Makarov et al. | 250/288 |
| 2003/0213901 | A1 | 11/2003 | Covey et al. | |
| 2004/0033679 | A1 * | 2/2004 | Jacobson et al. | 438/510 |
| 2004/0183006 | A1 * | 9/2004 | Reilly et al. | 250/282 |
| 2004/0183009 | A1 * | 9/2004 | Reilly et al. | 250/288 |
| 2004/0217276 | A1 * | 11/2004 | DiCesare | 250/288 |
| 2004/0219531 | A1 * | 11/2004 | DiCesare | 435/6 |
| 2005/0045815 | A1 * | 3/2005 | Bui | 250/282 |
| 2005/0139778 | A1 * | 6/2005 | Overney et al. | 250/423 P |
| 2005/0173627 | A1 * | 8/2005 | Cotter et al. | 250/288 |
| 2005/0280817 | A1 * | 12/2005 | Horchner et al. | 356/318 |

(Continued)

FOREIGN PATENT DOCUMENTS

| | | |
|---|---|---|
| JP | 08212964 | 8/1996 |
| JP | 2000162164 | 6/2000 |

OTHER PUBLICATIONS

Markus Stoeckli, et al., "Molecular imaging of amyloid beta peptides in mouse brain sections using mass spectrometry", Analytical Biochemistry, 311, 2002, 33-39, Elsevier Science.

(Continued)

*Primary Examiner* — Michael Logie
(74) *Attorney, Agent, or Firm* — Nutter McClennen & Fish LLP; Reza Mollaaghababa; Andrew W. Schultz

(57) ABSTRACT

A method for dynamic pixel mass spectrometric imaging, or dynamic pixel imaging is disclosed. The method includes striking a sample to be scanned with a laser beam so that the laser beam releases analytes from the sample. The laser beam and the sample are then displaced relative to one another so that the laser beam substantially continuously traces a predefined path on the sample to release analytes from the sample along the predefined path. A mass analysis of the released analytes is performed.

15 Claims, 6 Drawing Sheets

U.S. PATENT DOCUMENTS

| | | | | |
|---|---|---|---|---|
| 2006/0071160 | A1 | 4/2006 | Haase et al. | |
| 2006/0247863 | A1* | 11/2006 | Bui | 702/19 |
| 2007/0114388 | A1* | 5/2007 | Ogawa et al. | 250/288 |
| 2007/0141719 | A1* | 6/2007 | Bui | 436/173 |
| 2007/0148720 | A1* | 6/2007 | Torii et al. | 435/23 |

OTHER PUBLICATIONS

Rohner, et al., "MALDI mass spectrometer imaging of biological tissue sections," Mechanisms of Ageing and Development, Elsevier Sequoia, Lausanne, CH, vol. 126, No. 1, Jan. 1, 2005, pp. 177-185.

Spengler, B., et al., "Scanning microprobe matrix-assisted laser desorption ionizatino (SMALDI) mass spectrometry: instrumentation for sub-micrometer resolved LDI and MALDI surface analysis," Journal of the American Society for Mass Spectrometry, Elsevier Science Inc, US. vol. 13, No. 6, Jun. 1, 2002, pp. 735-748.

Henry, Celia, "Drawing with Mass Spec," Chemical & Engineering News, Science & Technology, vol. 82, No. 46, Nov. 15, 2005, pp. 33-35.

European Search Report dated Oct. 18, 2011 for European Application No. EP07784956.

* cited by examiner

DYNAMIC PIXEL SCANNING FOR USE WITH MALDI-MS

This application claims the benefit of U.S. Provisional Application No. 60/807,776, filed Jul. 19, 2006, the entire contents of this provisional application is hereby incorporated by reference.

The section headings used herein are for organizational purposes only and are not to be construed as limiting the subject matter described in any way.

FIELD

Applicants' teachings relate to dynamic pixel mass spectrometric imaging, or dynamic pixel imaging.

INTRODUCTION

Mass spectrometric imaging is a technique that uses a mass spectrometer to analyze a two dimensional surface for its molecular makeup. The image map created through mass spectrometric imaging is a mass or ion (m/z) intensity map that shows the detection of an ion or numerous ion signals across the surface of the sample. The sample can include, for example, tissue sections. A stationary spot-to-spot scanning method is used where a rectangular pixel is defined on the sample and the laser ablates ions from the sample but only in a single location with the pixel. A mass spectrum is acquired from the stationary spot within the pixel. The sample is then moved relative to the laser (through a sample stage) so that the laser is centered within the next pixel and a mass spectrum obtained. The sample stage is not moved while each spectrum is acquired. Accordingly, mass spectra are collected in a consecutive manner, pixel-by-pixel.

BRIEF DESCRIPTION OF THE DRAWINGS

The skilled person in the art will understand that the drawings, described below, are for illustration purposes only. The drawings are not intended to limit the scope of the applicants' teachings in any way.

DESCRIPTION OF VARIOUS EMBODIMENTS

Applicants' teachings relate to dynamic pixel mass spectrometric imaging or dynamic pixel imaging. In accordance with applicants' teachings, a method of scanning a sample, such as, for example, but not limited to, a tissue is disclosed.

Briefly, in accordance with applicants' teachings, the method of scanning the sample includes striking the sample to be scanned with a laser beam so that the laser beam releases analytes from the sample. The laser beam and the sample are displaced relative to one another so that the laser beam substantially continuously traces a predefined path on the sample to release analytes from the sample along the predefined path. A mass analysis of the released analytes is performed.

In accordance with some embodiments of applicants' teachings, the mass analysis is performed by a mass spectrometer. The resulting image generated is a mass or ion (m/z) intensity map that shows the detection of an ion or numerous ion signals across the surface of the sample.

Applicants' teachings can be used with a matrix assisted laser desorption ionization mass spectrometer (MALDI MS) instrument. Any mass spectrometer having a source that is capable of ionizing material off a suitable surface can be used, however.

In accordance with some embodiments of applicants' teachings, the laser can be a nitrogen laser operating at a pulsing frequency of, for example, but not limited to, 20 Hz. However, in accordance with applicants' teaching a higher frequency laser operation can be utilized, which, in turn, can shorten the accumulation time of the analytes from the specimen sample, while the maintaining the analyte detection sensitivity. For example, but not limited to, an Nd:YAG high-frequency laser operating at, for example, but not limited to, 1 kHz can be used.

In accordance with applicants' teachings, the laser beam and the sample are displaced relative to one another so that the laser beam substantially continuously traces a predefined path on the sample to release analytes from the sample along the predefined path. Typically, the sample is provided on a translational stage (not illustrated), and the translational stage displaces or moves the sample in both the X and Y-axis. A computer can control the movement of the translational stage.

Figure 1:
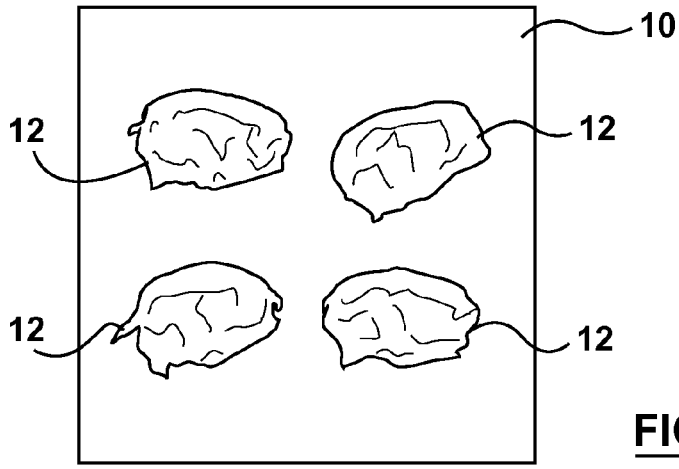
FIG. 1 shows samples mounted on a MALDI target plate.

In accordance with some embodiments of applicants' teachings, the laser beam substantially continuously traces a predefined path on the sample to release analytes as follows. Referring to the figures, FIG. 1 illustrates a MALDI target plate 10 upon which at least one sample 12 is mounted.

Figure 2:
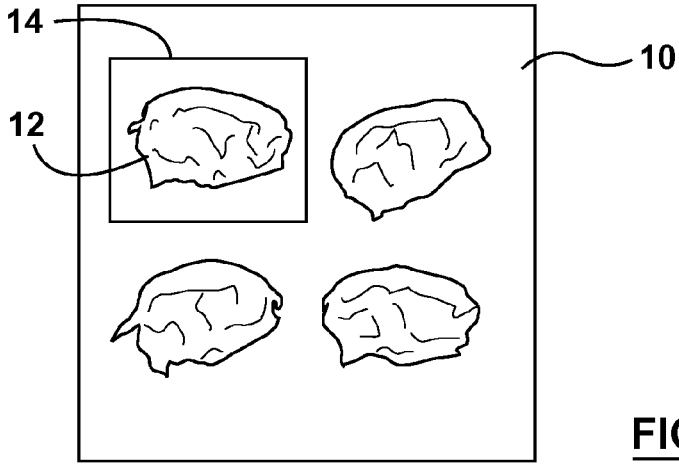
FIG. 2 shows an area for analysis defined on a sample from FIG. 1.

As illustrated in FIG. 2, an area for analysis is then selected on the target plate. In accordance with applicants' teachings, a virtual confined area in relation to the sample is created. The confined area is to define boundaries that the laser beam substantially continuously traces the predefined path on the sample 12. In FIG. 2 the selected confined area is illustrated at 14. In various embodiments of applicants' teachings, a computer generates the confined area.

Figure 3:
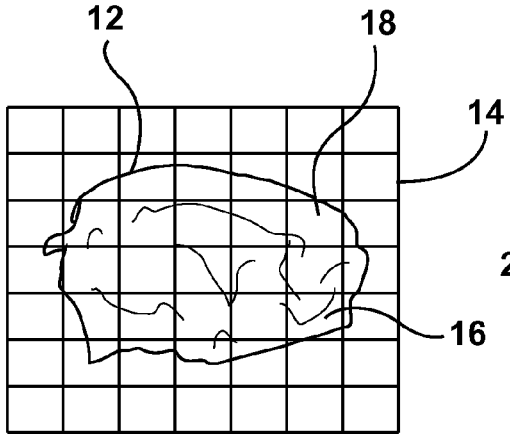
FIG. 3 shows the enlarged area from FIG. 2 subdivided into pixels.

In accordance with various embodiments of applicants' teachings, the predefined area can be further divided into a plurality of parcels, and, for some embodiments, the parcels can be smaller pixels or grids. FIG. 3 illustrates area 14 for sample 12 divided into a plurality of grids or pixels 16. A computer can divide the confined area 14 into the plurality of grids or pixels.

Figure 4:
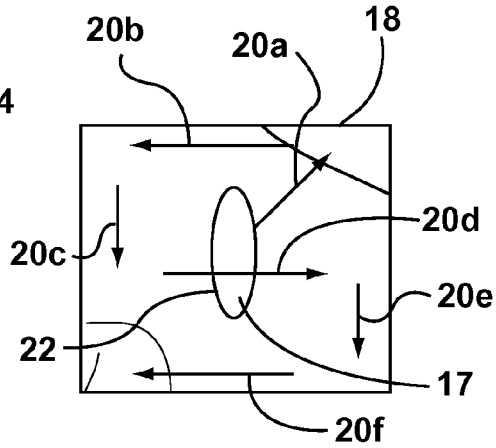
FIG. 4 shows a predefined path of a laser within an individual pixel from FIG. 3.

For purposes of illustrating applicants' teachings one of the pixels 16 from FIG. 3 is enlarged, as illustrated in FIG. 4. The enlarged pixel, 18, will be used to show the predefined path of the laser beam in accordance with some embodiments of applicants' teachings and having regard to arrows 20*a*-20*f*.

In particular, the laser beam 17 starts at a pre-selected location in the selected pixel 18. For some embodiments of applicants' teachings, the starting location can be, for example, but not limited to, location 22—the centre of the pixel 18—as illustrated in FIG. 4. Starting at location 22, the laser beam substantially continuously traces a path along the arrow 20*a*, whereupon the path changes direction and continues as indicated by the arrow 20*b*, whereupon the path changes and continues as indicated by the arrow 20*c*, whereupon the path changes and continues as indicated by the arrow 20*d*, whereupon the path changes and continues as indicated by the arrow 20*e*, and whereupon the path changes and continues as indicated by the arrow 20*f*. The path illustrated in FIG. 4 is by way of example only, and in accordance with applicants' teachings, any other continuous trace within the pixel can also apply.

Moreover, in accordance with applicants' teachings, the laser beam substantially continuously traces the predefined path, 20*a*-20*f* for FIG. 4, on the sample 12, and therefore analytes are released from the sample 12 substantially continuously where the laser strikes the sample 12 along the predefined path. Accordingly, mass spectra are collected from sample 12 as the laser beam is substantially continuously being displaced relative to the sample.

The dynamic pixel scanning technique of applicants' teachings is implemented as a synchronous real-time process so that each pixel scanned corresponds to an area of movement between the laser and the sample. The movement, pattern, speed, duration can be consistent from pixel to pixel. For some embodiments for each area of movement, the sample starts to move after the laser has been turned on and stops after the laser has been turned off. The laser is then positioned to the appropriate location of an adjacent pixel, the laser turned on, and the process repeated until the predefined path for the laser within the adjacent pixel is complete, whereupon the laser is turned off and the movement of the sample is stopped. The laser is then positioned as before in a further adjacent pixel and the process repeated until the sample is fully scanned. In some embodiments of applications teachings, the laser remains on and is displaced relative to the sample so that the sample is scanned substantially continuously.

Aspects of the applicants' teachings may be further understood in light of the following examples, which should not be construed as limiting the scope of the present teachings in any way.

Figure 5:
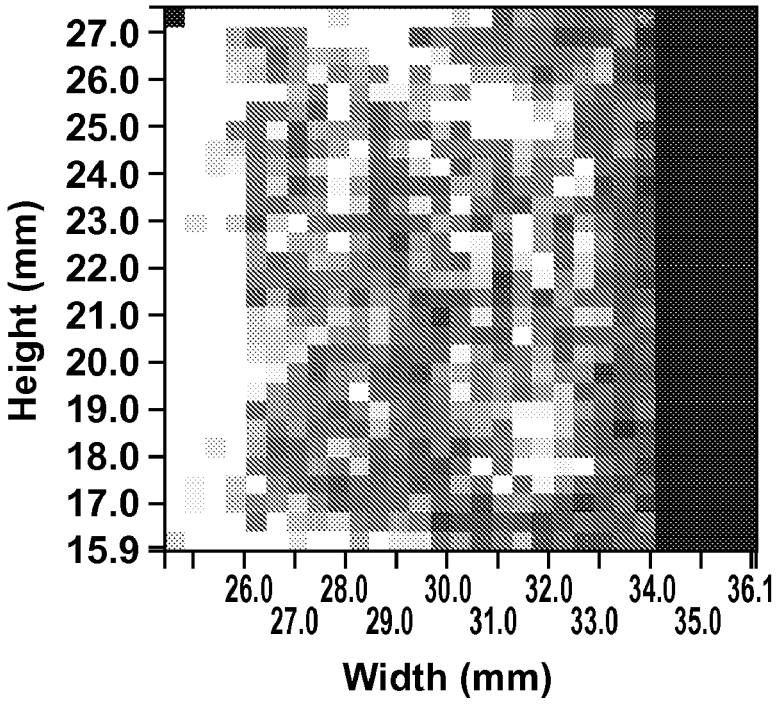
FIG. 5 shows a dynamic pixel mass spectrometric image for an individual pixel acquired on a coronal section of a rat brain.

The mass analysis of analytes released from the sample 12 as the laser beam is substantially continuously displaced relative to the sample is used to plot a distribution of peak intensity of select compounds. FIG. 5 shows a dynamic pixel mass spectrometric image of a drug-dosed tissue; in particular, FIG. 5 is a coronal section of a rat brain. The matrix used for this example is a sinapinic acid matrix, though other suitable matrix's can be used as is known in the art. The sample is imaged in MSMS mode. The parent mass is 347 Daltons and the fragment detected is 112 Daltons. The dynamic pixel mass spectrometric image shown in FIG. 5 is generated by the detection of the 112 Dalton ions over the surface of the sample of the coronal section of a rat brain. In FIG. 5 the white pixels designate the most concentrated areas of molecule detection, black shows no detection of analyte, and the grey shades show various degrees of detection of analyte.

Figure 6:
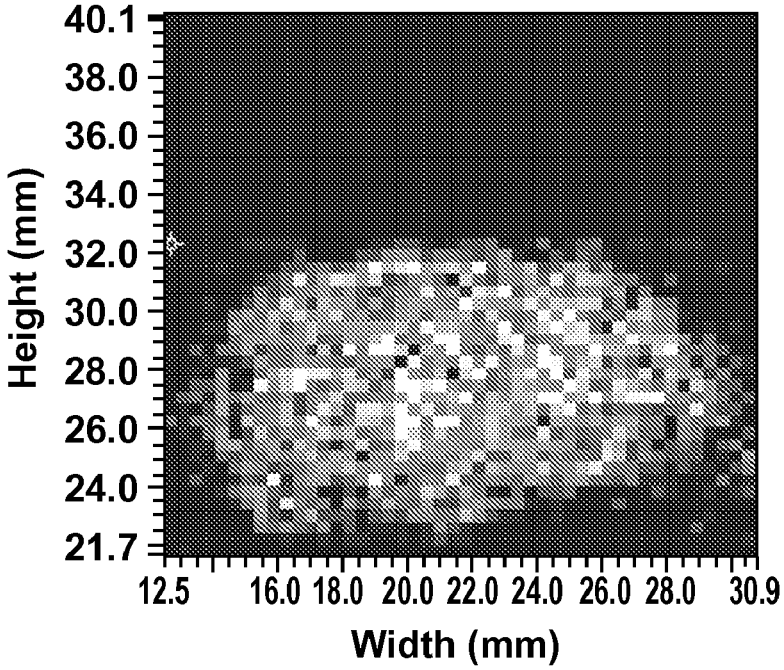
FIG. 6 shows a final image obtained from the dynamic pixel imaging technique acquired on a sagittal section of a rat brain.

FIG. 6 shows a similar image to that obtained for FIG. 5 using dynamic pixel mass spectrometric imaging of applicants' teachings, but for a sagittal section of a rat brain. Again, the white pixels designate the most concentrated areas of molecule detection, black shows no detection of analyte, and the grey shades show various degrees of detection of analyte.

Figure 8:
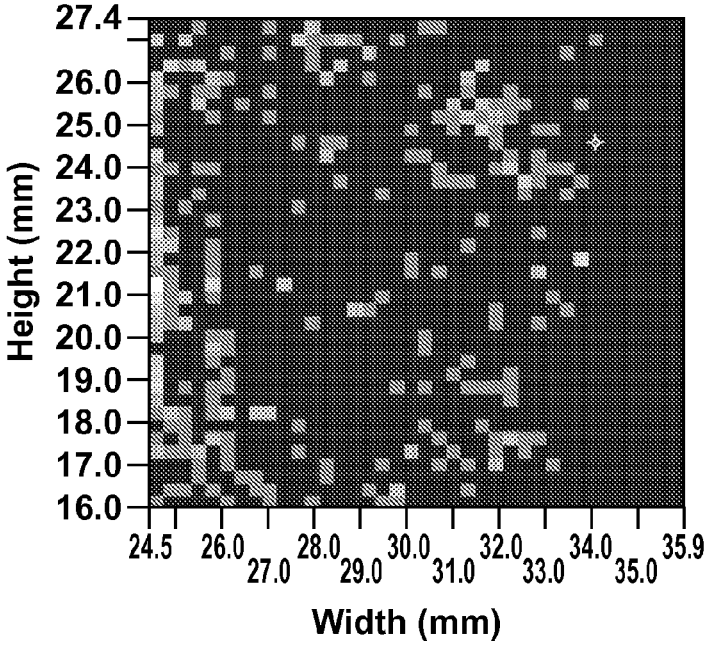
FIG. 8 shows a mass spectrometric image using the mass spectrometric imaging technique of FIG. 7.

For this example, the improved sensitivity of applicants' teachings can be appreciated by comparing the images from FIGS. 5 and 6 to that obtained through static mass spectrometric imaging techniques (see FIG. 8).

Figure 7:
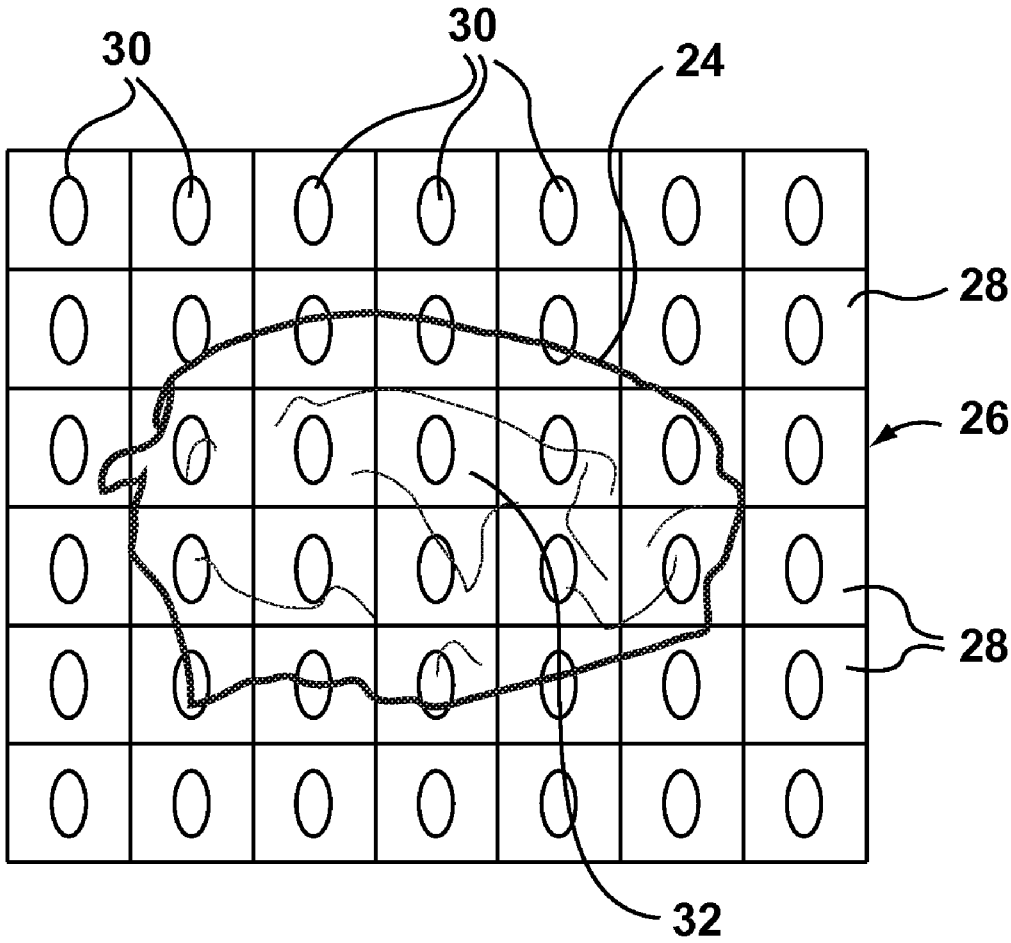
FIG. 7 shows a pixel-by-pixel mass spectrometric imaging technique.

Static mass spectrometric imaging techniques have the plurality of grids or pixels scanned pixel-by-pixel, as illustrated in FIG. 7. In particular, static mass spectrometric imaging techniques have a mass spectrum acquired from a stationary spot within each pixel. In FIG. 7 a sample 24 is provided within a confined boundary 26. Boundary 26 is subdivided into pixels 28. The mass spectrum is acquired from stationary spots 30 within each pixel, as follows. For each pixel, the translational stage is moved so that laser is centered within an adjacent pixel at spot 30. Once centered, the mass spectrum is obtained. Each mass spectrum has a locator tag associated with it to determine the position of the sample on the target plate. For static spectrometric imaging, the translational stage is not moved when the spectrum for the pixel is acquired, however.

For purposes of this example, sample 24 is the same tissue, i.e., a sagittal section of a rat brain, as was imaged using applicants' teachings and shown in FIG. 6.

FIG. 8 illustrates a static mass spectrometric image for tissue 24 that is drug-dosed. Again, the matrix used for this example is a sinapinic acid matrix, though other suitable matrix's can be used as is known in the art. The sample is imaged in MSMS mode. The parent mass is 347 Daltons and the fragment detected is 112 Daltons. The mass spectrometric image shown in FIG. 8 is generated by the detection of the 112 Dalton ions from the centre 28 of each pixel while the laser and sample remain stationary with respect to one another. The spectrum is collected pixel-by-pixel. In FIG. 8 the white pixels designate the most concentrated areas of molecule detection, black shows no detection of analyte, and the grey shades show various degrees of detection of analyte.

Comparing the dynamic pixel imaging techniques of applicants' teachings from FIG. 5 to the static mass spectrometric image shown in FIG. 8 it can be shown that applicants' teachings increases the sensitivity of detection of compounds. Also, for purposes of this example, the static mass spectrometric image shown in FIG. 8 was obtained first. After the image shown in FIG. 8 was obtained, the same sample was subjected to the dynamic pixel imaging techniques of applicants' teachings to produce the image shown in FIG. 5, but having increased sensitivity of detection of compounds.

In the dynamic pixel imaging technique of applicants' teachings, the analytes are released from the sample by the laser beam as it substantially continuously traces a predefined path on the sample. Therefore, a mass spectrum is acquired while the laser beam and sample are displaced relative to one another. In accordance with applicants' teachings, for dynamic pixel imaging, the laser can cover more area within each pixel. Moreover, the acquisition time per pixel can remain the same as in mass spectrometric image techniques.

Figure 9A:
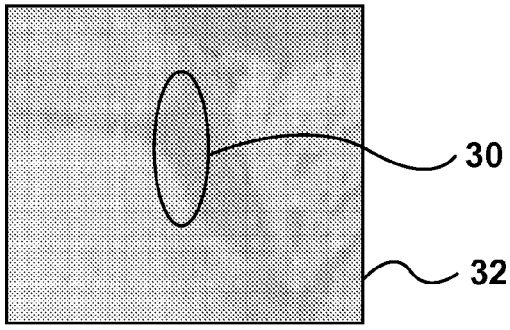
FIG. 9*a* shows an enlarged section of an individual pixel from FIG. 7.
Figure 9B:
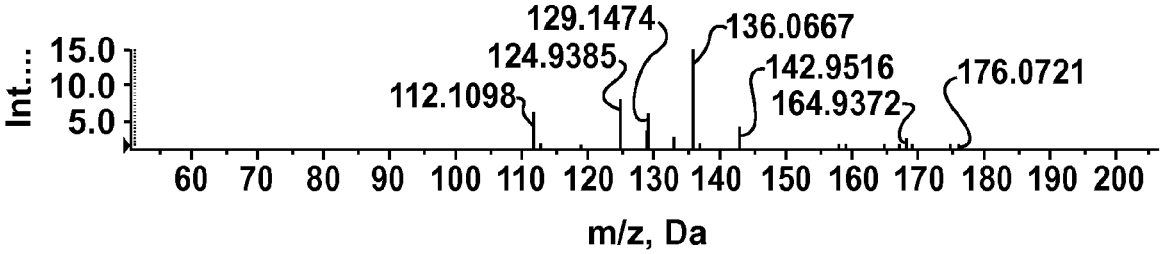
FIG. 9*b* shows a graph of the mass spectra collected from the pixel indicated in FIG. 9*a;*
Figure 10A:
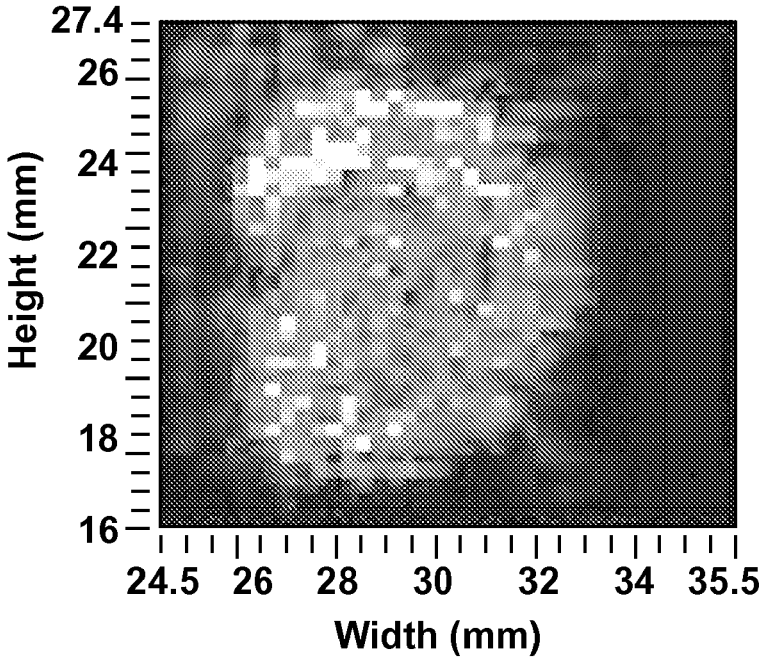
FIG. 10*a* shows an image using the mass spectrometric imaging technique.
Figure 10B:
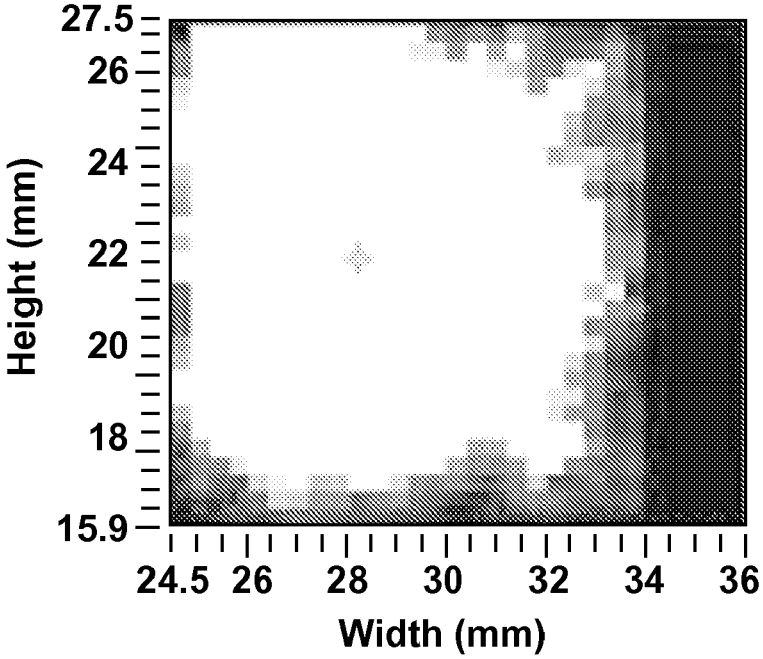
FIG. 10*b* shows an image similar to FIG. 10*a*, but using the dynamic pixel imaging technique.

Another example can be illustrated having regard to FIG. 7, and the examples from FIGS. 9*a* and 9*b* and FIG. 10*a*—all of which show the results using static mass spectrometric imaging techniques—and comparing to FIG. 10*b*, an image of the same sample, produced after the static mass spectrometric imaging techniques of FIG. 10*a*, but using the dynamic pixel imaging technique of applicants' teachings. For purposes of this example, the sample shown and imaged in FIGS. 10*a* and 10*b* is the same tissue sample that was imaged in FIGS. 8 and 5, namely, a coronal section of a rat's brain.

A select pixel 32 from FIG. 7 is illustrated in FIG. 9*a*. The laser strikes the stationary sample in the centre spot 30 of pixel 32. A mass spectrum of the individual pixel 32 is collected using static mass spectrometric imaging as shown in 9*b*.

An ion m/z intensity map can than be generated over the entire 2-dimensional area where mass spectra is acquired in sample 24. FIG. 10*a* is an ion intensity map using static mass spectrometry imaging of a native compound in the sample, namely, compound adenosine monophosphate (AMP). The parent mass is 348 Daltons, and the fragment detected is 136 Daltons. Again, white indicates the highest level of detection, and black indicates no detection. Gray levels show moderate levels of detection.

FIG. 10*b* shows the detected 136 Dalton fragment ion from the parent 348 Dalton mass, but displayed in an ion intensity map using dynamic pixel imaging of applicants' teachings. As in the previous example, the same sample is subjected to the dynamic pixel imaging techniques of applicants' teachings after being subjected to the static mass spectrometry imaging to produce FIG. 10*a*. Again, for FIG. 10*b*, white indicates the highest level of detection, and black indicates no detection. Gray levels show moderate levels of detection. FIG. 10*b* can be seen to be ten times (10×) as bright as the image from FIG. 10*a*.

For MALDI applications applicants have noted that quenching can occur when the laser is maintained in a fixed position relative to the tissue for longer than select periods of time. The quenching process may be caused by a physical change in the matrix compound structure at the surface of matrix crystals, or by localized heating caused by prolonged exposure to the heat intensity of, for example, a high frequency laser. The quenching process effectively reduces the laser absorption by the tissue/matrix target and can suppress MALDI ion formation at the source.

Applicants have noted that with mass spectrometric imaging, higher frequency lasers, such as, for example, 1 kHz can cause quenching of the matrix ablation process. A high frequency laser, such as 1 kHz, at a fixed position relative to the tissue, can quench the matrix in about 200 milliseconds. A low frequency laser [e.g., a Nitrogen laser] at a fixed tissue position can take 10 to 15 seconds before quenching occurs. A high frequency laser can shorten the accumulation time of the analytes.

In accordance with applicants' teachings, a confined area of movement for the laser so that the laser substantially continuously traces a predefined path on the sample appears to allow sufficient matrix cooling, effectively preventing matrix quenching at any given spot.

Moreover, in accordance with applicants' teachings, a continuous movement of the laser can also improve ionization from tissue regardless of the quenching reaction that has been observed. Applicant believes there are two steps that can occur during MALDI ionization. The ablation phenomenon is a high-energy process that expels matrix (with co-crystallized analytes) off the sample surface. The second process occurs as the laser interacts with the plume of analyte ions. Applicant believes that the second process occurs off the surface of the sample in the gas phase and may still involve an energy transfer from the laser via the matrix ions/cluster ions to the analyte molecules. This secondary process seems to be assisted when the laser is moving continuously on matrix-coated surfaces.

The rectangular confined area of movement for the laser is defined by horizontal and vertical resolution settings that any user can predefine in the image acquisition method, using, for example, computer software. Basically, each area of movement can represent a pixel 16 as shown in FIG. 3. In stationary spot-to-spot scanning, i.e., mass spectrometric imaging illustrated in FIG. 7, the laser ablates only in the center of a pixel. If the area of the rectangular pixel is larger than the laser spot on the tissue, then only a portion of the pixel is actually scanned. This would not give a true representative scan for large pixel areas.

Dynamic pixel imaging, however, provides constant movement of the sample target relative to the laser within the confined area in real-time, and allows sufficient matrix cooling, effectively preventing matrix quenching at any given spot. In accordance with applicants' examples detailed above, applicants' teachings show that dynamic pixel imaging provides a measured 10-20 times sensitivity improvement. Accordingly, applicants' teachings allow for high speed detection of analytes in tissue samples with very low abundances of compounds to be detected.

The confined virtual areas illustrated in FIGS. 2 and 3 (where FIG. 3 illustrates the area being subdivided into smaller pixels or grids) were typically created virtually in a computer. The computer can then displace the sample relative to the laser beam so that laser substantially continuously traces a predefined path within the virtual confine area. Typically, the sample is provided on a translational stage which can move the sample in both X and Y-axis.

Since the laser and sample are in substantially continuous movement in relation to one another, in accordance with applicants' teachings, analysis over a specified pixel can be carried out for a much longer time frame. This can facilitate multiple reaction monitoring for many compounds when a mass spectrometer is running, for example, a tandem mass spectra experiment, such as, for example, product ion scans. In other words, within one imaging run, multiple experiments can be acquired within the same pixel simultaneously. Each of the contained experiments can have different acquisition parameters. This also will lead to the ability to do information dependant acquisition (IDA) as an image experiment is being run. Imaging IDA will result from a software tool that uses an initial survey MS experiment to determine what additional dependent experiments to run, for each pixel as the image is acquired.

Moreover, in time of flight (TOF) MS mode, spectra can be acquired until the matrix has been fully ablated allowing for improved sensitivity and better detection of low abundance species within the sample.

In accordance with various embodiments of the applicants' teachings, mass spectrum analysis of a 2-dimensional sample can occur with the sample stage kept in constant motion so that the laser defines a predefined path or pattern that covers an entire area of the sample.

Figure 11:
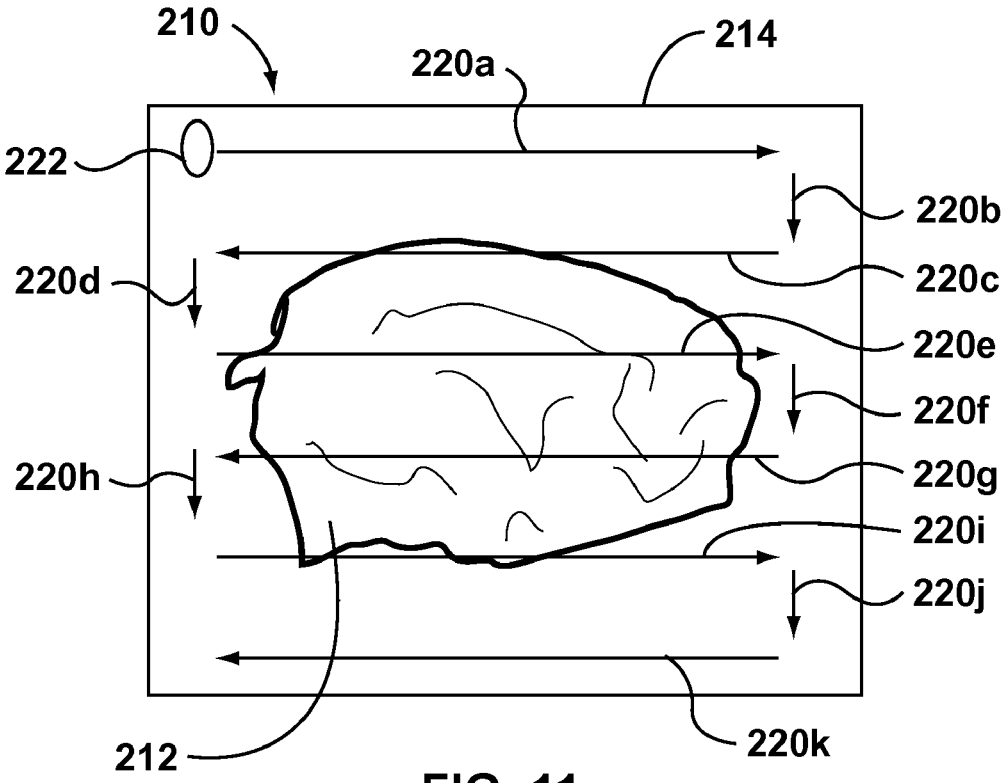
FIG. 11 shows a predefined path of the laser over the sample in accordance with various embodiments of applicants teaching.

FIG. 11 illustrates a sample 212 on a MALDI plate 210. A suitable confined area 214 is defined around the entire sample 212. Similar to FIG. 4, a predefined path for the laser is selected so that the laser substantially continuously traces a path, designated by arrows 220*a*-220*k* in FIG. 11. Each time the mass spectrometer records a mass spectrum, for example, when the laser beam engages the sample as at 222, a mass spectrum is recorded and the software can produce a position reference tag so that the software can determine the position of the sample on the target plate.

Figure 12:
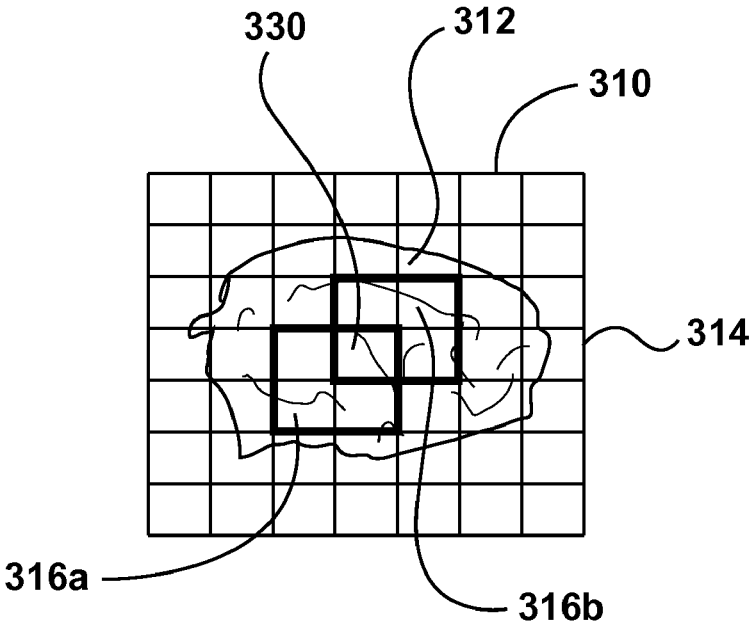
FIG. 12 shows an enlarged area from FIG. 2 subdivided into offset pixels.

FIG. 12 illustrates various embodiments of applicants' teachings where the dynamic pixel imaging method can produce higher resolution images without having to decrease the spot size of the laser. For the various embodiments of applicants' teachings as shown in FIG. 12, a sample 312 is provided on a MALDI plate 310 and a confined area 314 is defined similar to FIG. 3.

A confined area on the sample, such as grids or pixels 316*a* is then created, and, as before having regard to FIG. 4, the laser is displaced relative to the sample so that the beam substantially continuously traces a predetermined path on the sample within the grid 316*a*. As illustrated in FIG. 12, at least one other confined area, such as grids or pixels 316*b* is virtually created in relation to the first defined area or pixels 316*a*. The at least one other confined area defines boundaries that the laser beam substantially continuously traces at least one other predefined path on the sample.

Mass analysis of the analytes from the laser beam over all the predefined areas is obtained. Distribution peak of the intensity of the select compounds from the analytes within the respective confined areas can be plotted in accordance with the embodiments described earlier. Peak intensities from the regions where the confined areas overlap, such as at 330, is summed. In accordance with applicants' teachings, increased resolution images of the sample can be obtained. Without summing overlapped area, the higher resolutions would have to be obtained by decreasing the spot size of the laser, however, this increases the time within which equivalent data can be collected.

In accordance with some embodiments of applicants' teachings, the peak intensities through the regions where the first confined area and the other confined areas overlap can be de-convoluted mathematically, using, for example, but not limited to, astronomy techniques for making a high resolution image with a lower resolution image, such as "Drizzle," that was developed by NASA for the Hubble Space Telescope.

Further, in accordance with some embodiments of applicants' teachings, after the laser continuously traces a predefined path on the sample the laser beam and the sample are subsequently displaced relative to one another so that the laser beams substantially continuously traces at least a second predefined path on the sample that is substantially coterminous over at least a portion of the first predefined path. By performing multiple runs on a sample then summing the spectra obtained, noise in the signal can be reduced.

While the applicants' teachings are described in conjunction with various embodiments, it is not intended that the applicants' teachings be limited to such embodiments. On the contrary, the applicants' teachings encompass various alternatives, modifications, and equivalents, as will be appreciated by those of skill in the art.

The invention claimed is:

1. A method of scanning a sample, the method comprising:

(a) creating a virtual confined area in relation to the sample, the confined area being a grid divided into a plurality of parcels that are grid elements;

(b) striking the sample to be scanned with a laser beam so as to release analytes from the sample;

(c) displacing the laser beam and the sample substantially continuously relative to one another, so that the laser beam substantially continuously traces a predefined path within a grid element in the confined area, so that when the laser beam strikes the sample within the grid element, analytes are released from the sample, the laser beam substantially continuously traces a predefined path over the confined area by tracing a predefined path within each successive grid element until the entire predefined path over the confined area has been traced;

(d) obtaining mass spectra of the released analytes while the laser beam and the sample are displaced relative to one another; and (e) performing a mass analysis of the released analytes.

2. The method according to claim 1, wherein the mass analysis of the released analytes is used to plot a distribution of peak intensities of select compounds from the analytes released from the sample along the predefined path.

3. The method according to claim 2, wherein size of the parcels are selected in relation to the size of the laser beam to set the resolution and sensitivity of the distribution plot.

4. The method according to claim 1, wherein the sample is provided with an energy absorbent matrix.

5. The method according to claim 1, wherein the laser strikes the sample at a select pulsing frequency.

6. The method according to claim 1, further comprising virtually creating at least one other confined area in relation to the sample, the at least one other confined area defining the boundaries that the laser beam substantially continuously traces at least one other predefined path on the sample, and performing a mass analysis of released analytes from the laser beam in the at least one other confined area.

7. The method according to claim 6, wherein the mass analysis obtained from the first confined area and the at least one other confined area are used to plot a distribution of peak intensities of select compounds from the analytes within the respective confined areas.

8. The method according to claim 7, wherein the peak intensities from the regions where the first confined area and the at least one other confined area overlap are summed.

9. The method according to claim 7, wherein the peak intensities from the regions where the first confined area and the at least one other confined area overlap are de-convoluted mathematically.

10. The method according to claim 1, wherein after tracing a first predefined path, the laser beam and the sample are subsequently displaced relative to one another so that the laser beam substantially continuously traces at least a second predefined path on the sample that is substantially coterminous with at least a portion of the first predefined path.

11. The method according to claim 1, wherein the mass analysis is performed by a mass spectrometer.

12. The method according to claim 11, wherein the mass spectrometer is a time-of-flight mass spectrometer, triple quadrupole mass spectrometer, or ion trap mass spectrometer.

13. The method according to claim 1, wherein the confined virtual area is generated by a computer.

14. The method according to claim 13, wherein the displacement of the laser beam relative to the sample is controlled by the computer.

15. The method according to claim 1, wherein the plurality of parcels are pixels.

* * * * *